US005086375A

United States Patent [19]

Fabbri et al.

[11] Patent Number: 5,086,375

[45] Date of Patent: Feb. 4, 1992

[54] MODULAR MEDICAL LIGHT SYSTEM

[75] Inventors: William C. Fabbri, Billerica; Roy B. Crane, Wilmington, both of Mass.

[73] Assignee: Keene Corporation, Union, N.J.

[21] Appl. No.: 693,696

[22] Filed: Apr. 30, 1991

Related U.S. Application Data

[63] Continuation-in-part of Ser. No. 629,436, Dec. 18, 1990, Pat. No. 5,038,254.

[51] Int. Cl.[5] ..... F21V 13/00

[52] U.S. Cl. ..... 362/33; 362/225; 362/147; 362/242; 362/343; 362/364; 362/801; 362/804

[58] Field of Search ..... 362/33, 147, 225, 234, 362/240, 242, 249, 253, 364, 365, 804, 801, 216, 303, 305, 343

[56] References Cited

U.S. PATENT DOCUMENTS

| | | | |
|---|---|---|---|
| 2,998,508 | 8/1961 | Bobrick | 362/801 X |
| 3,928,757 | 12/1975 | Nelson | 362/804 X |
| 4,204,274 | 5/1980 | Lüderitz | 362/225 X |
| 5,038,254 | 8/1991 | Fabbri et al. | 362/33 |

*Primary Examiner*—Stephen F. Husar

*Attorney, Agent, or Firm*—Kane, Dalsimer, Sullivan, Kurucz, Levy, Eisele and Richard

[57] ABSTRACT

The apparatus is a modular medical lighting system which includes a ceiling-mounted reading light module, examination light module and ambient light module. The reading light is directed toward a selected reading area on a hospital bed directly below the medical lighting system. The examination light illuminates the entire top surface of the hospital bed. The ambient light directs light to a wall abutting the head of the hospital bed thereby providing reflected light to the vicinity of the hospital bed. The modules may be provided separately or in combination.

44 Claims, 9 Drawing Sheets

MODULAR MEDICAL LIGHT SYSTEM

This application is a continuation-in-part of U.S. application Ser. No. 07/629,436, filed Dec. 18, 1990 now U.S. Pat. No. 5,038,254.

BACKGROUND OF THE INVENTION

1. Field of the Invention

This invention pertains to a light system for use in hospitals and health facilities. The light system includes an examination light, an ambient light, and a reading light and is preferably mounted in the ceiling.

2. Description of the Prior Art

In hospitals and similar health or medical facilities, it is desirable to provide the bedridden patient with three types of lights—the first is an ambient light which provides background, preferably reflected, light to a large area surrounding the bed; the second is a reading light which provides direct light to a portion of the patient's bed; and the third is an examination light which directs a high intensity light to substantially the entire area of the patient's bed. The ambient light typically has an illumination value of approximately 50 foot-candles while the reading light typically has an illumination value of approximately 70 foot-candles and the examination light typically has an illumination value of approximately 100 foot-candles.

Additionally, it is desirable to provide a reading light in which the patient and visitors are not exposed to any glare from the fixture regardless of whether the patient is lying flat, sitting up in a reading position, or reclining on the bed in any position in between the flat or reading position.

Moreover, it is desirable to provide an ambient light wherein an indirect light is bounced from the wall to provide light appropriate for the patient to relax, watch television, or receive visitors.

Similarly, it is desirable to provide an examination light in a down-light module that focuses light substantially within the length of the bed for examination of the patient by the medical staff. It is further desirable to provide such a light within a module which can be used individually or repeated as many times as necessary to achieve the level of light appropriate for the type of care being given. When more than one module is used, the modules could be switched separately to provide different intensities of light.

In the prior art, these lights were typically provided individually in a haphazard way. Different types of lamps and light fixtures were placed around the bed with numerous plugs competing with medical equipment for available outlet space. Moreover, such an arrangement was unsightly and could impede the mobility of the patient, the patient's bed, or the surrounding medical equipment.

Wall-mounted fixtures alleviated some of the above-identified deficiencies but still left much to b desired aesthetically and, more importantly, could impede access to the patient, and were easily damaged by motor driven bed headboards.

Additionally, in the prior art, medical lights have not been provided within modules so that different combinations of reading, ambient, and examination lights could be incorporated into a single fixture.

OBJECTS AND SUMMARY OF THE INVENTION

It is therefore an object of this invention to provide a modular medical lighting system with a reading light module, an ambient light module, and an examination light module.

It is therefore a further object of this invention to provide a modular medical lighting system wherein the reading light module, the ambient light module and the examination light module can be combined within a standard-sized light fixture, used individually, or combined into pairs.

It is therefore a further object of this invention to provide a modular medical lighting system wherein the reading light does not expose the patient or visitors to glare regardless of whether the patient is lying flat, sitting up in a reading position, or reclining on the bed in any position in between the flat or reading position.

It is therefore a still further object of this invention to provide a modular medical lighting system including an ambient light wherein an indirect light is bounced from the wall to provide light appropriate for the patient to relax, watch television, or receive visitors.

It is therefore a still further object of this invention to provide a modular medical lighting system including an examination light in down-light module that focuses light substantially within the length of the bed for examination of the patient by the medical staff.

It is therefore a final object of this invention to provide a modular medical lighting system wherein the examination light is provided within a module which can be used individually or repeated as many times as necessary to vary the level of light.

These and other objects are effectively attained by providing a ceiling-mounted medical lighting system which includes three individual dedicated modular light fixtures. Preferably, one of each of the three modules are combined to form a lighting fixture which is designed to be placed so that one of the shorter ends of the rectangle is placed substantially on the ceiling-wall interface directly over the head of the patient's bed. The bed is placed so that the longer sides of the bed are parallel to the longer sides of the rectangular light fixture. However, the modules can be used individually or combined into pairs to provide limited number of the above-identified functions.

A first modular light fixture includes a fluorescent bulb and a reflector designed to direct light toward the forward portion of the patient's bed so as to allow a patient to read comfortably. A second modular light fixture includes a fluorescent bulb and a reflector designed to direct light toward a vertical wall abutting the head of the patient's bed so as to provide a reflected light over a large area around the patient's bed. A third modular light fixture includes two to four fluorescent bulbs which are oriented perpendicularly to the bed. The fluorescent bulbs have a light distribution pattern which is substantially oriented in the direction perpendicular to the bulb. Therefore, the entire area of the bed is efficiently illuminated providing an examination light.

The fluorescent bulbs in all of the modules are preferably biax ® or other U-shaped bulbs.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
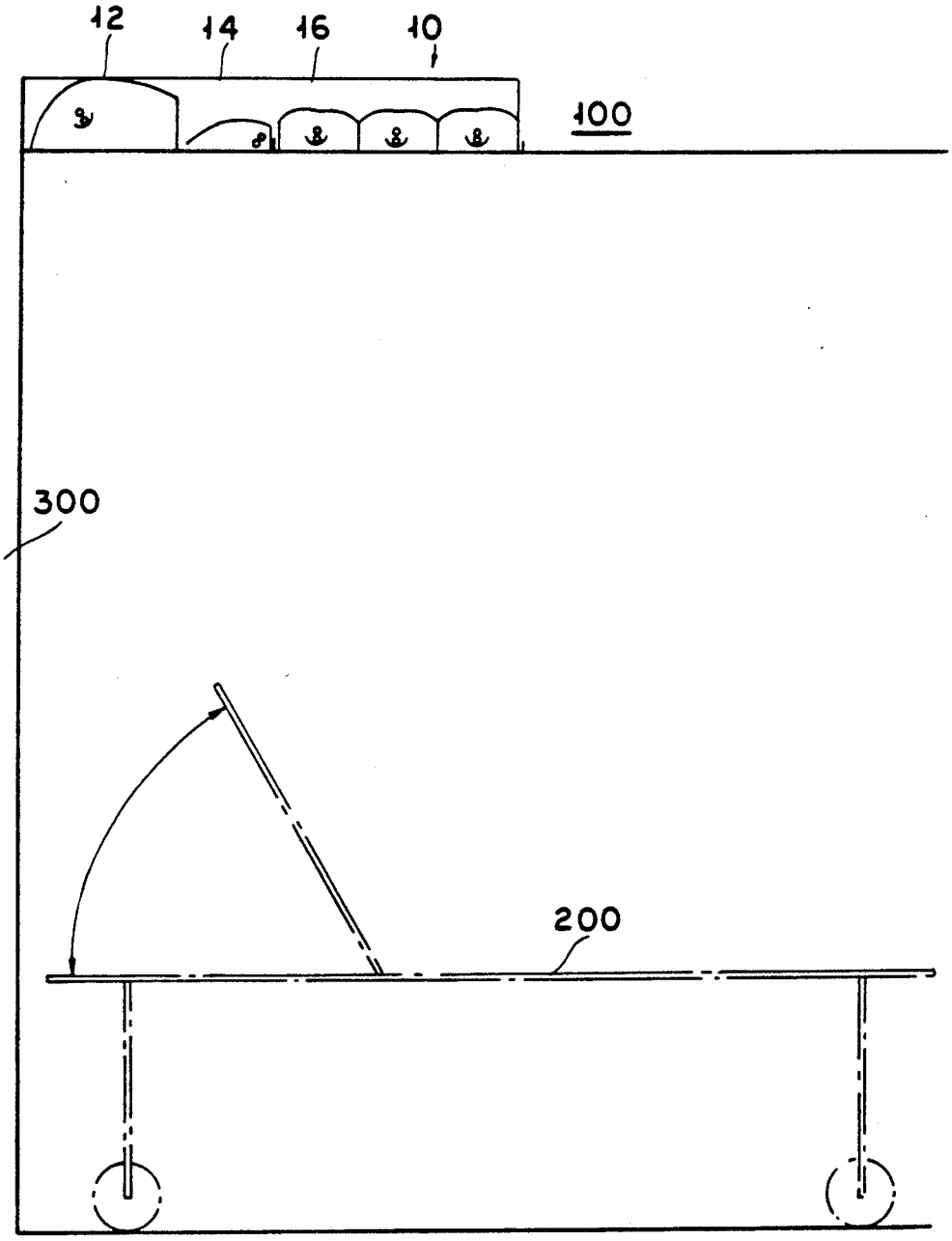
FIG. 1 is a side plan view, partly in cross section, of the modular medical light system of the present invention.
Figure 2:
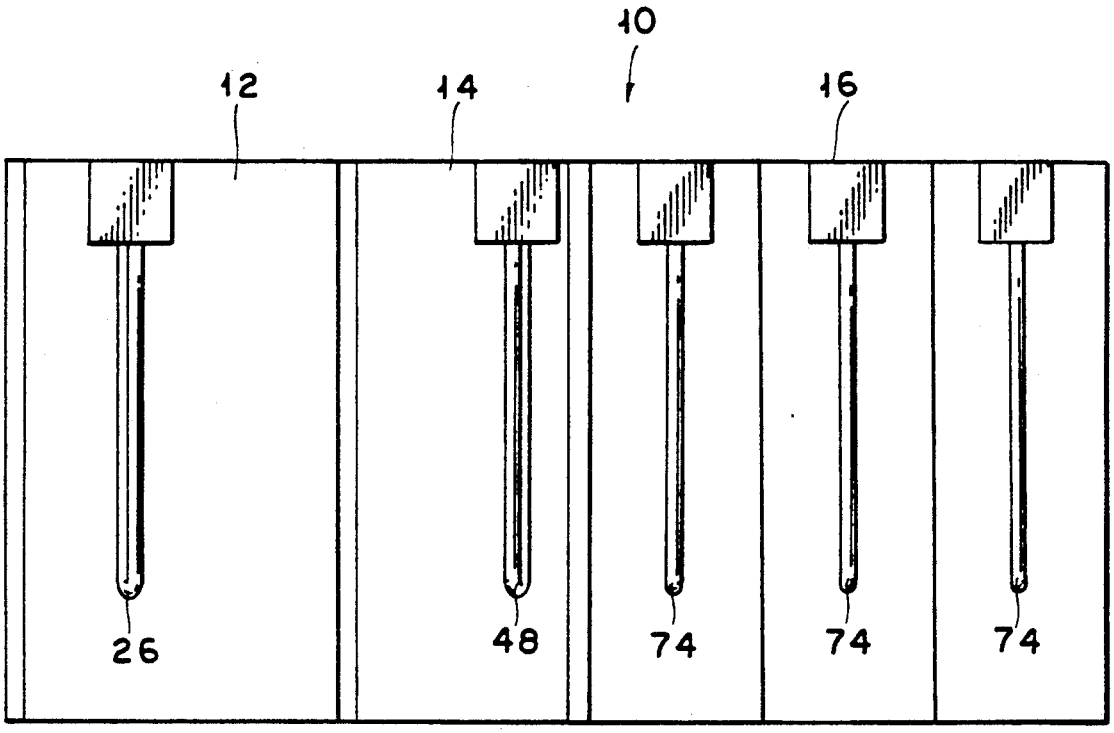
FIG. 2 is a bottom plan view of the modular medical light system of the present invention (with the shields around the fluorescent bulbs removed).

Referring now to the drawings in detail wherein like numerals indicate like elements throughout the several views, FIG. 1 is a side plan view, partly in cross section, of the modular medical lighting system 10 of the present invention while FIG. 2 is a bottom plan view of modular medical lighting system 10. Modular medical lighting system 10 is mounted in ceiling 100, directly over a patient's bed 200, and preferably adjacent to wall 300. Preferably, modular medical lighting is four feet long and two feet wide to conform to standard lighting fixture sizes.

Modular medical lighting system 10, in its complete and preferred embodiment, includes reading light module 12, ambient light module 14, and examination light module 16. As disclosed in commonly owned application Ser. NO. 07/629,436, now U.S. Pat. No. 5,038,254 the reading light module 12, the ambient light module 14, and the examination light module 16 may be integrated into a single light fixture. However, these modules may also be provided separately and placed within a housing. Moreover, as shown in FIGS. 9–12, less than all three modules may be placed within the housing for a limited number of functions to be provided.

Figure 3:
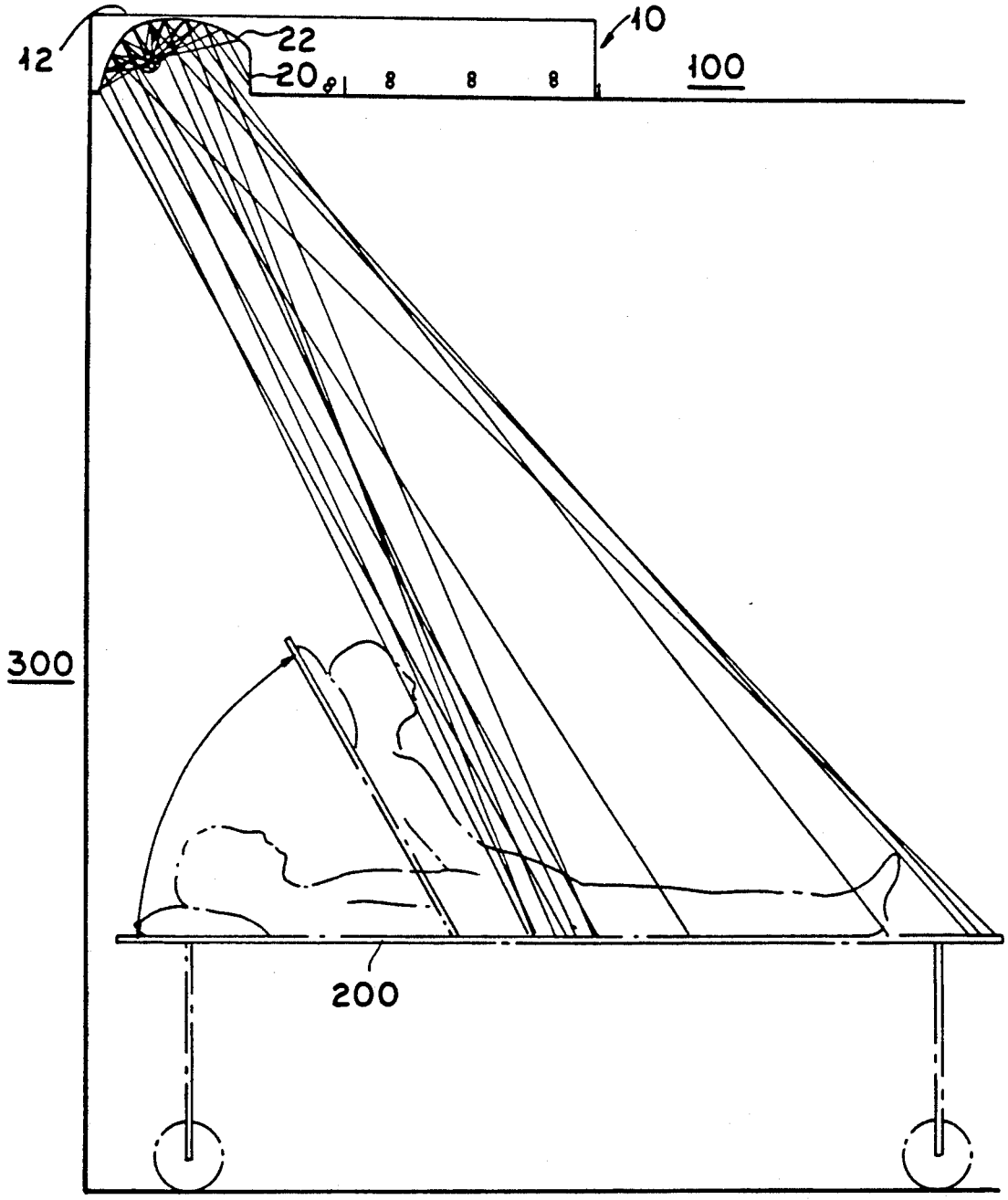
FIG. 3 is a side plan view, partly in cross section, of the modular medical light system showing the area of illumination of the reading light module.

FIG. 3 shows the light distribution pattern of reading light module 12 in relation to the patient reposing upon bed 200. As the light is directed at an angle away from wall 300, the light is not directed into the patient's eyes, regardless of whether the position of the head of bed 200 is in a fully reclining or partially elevated (i.e., a "sitting up" position). Similarly, as the light distribution pattern of reading light module 12 is limited by non-reflective barrier 20, visitors and other people standing proximate to bed 200 ar not exposed to glare from reading light module 12.

Figure 4:
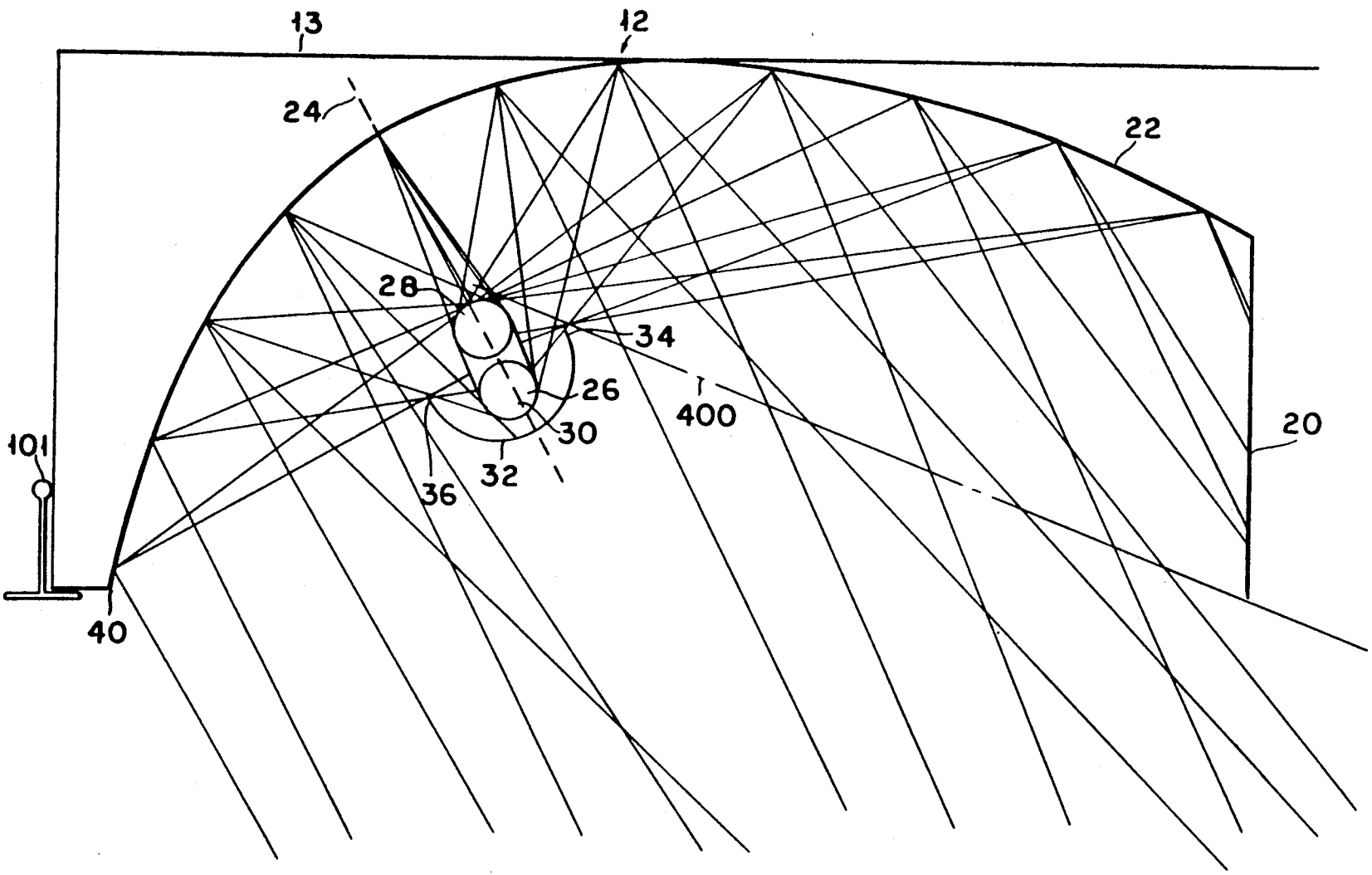
FIG. 4 is a side plan view, partly in cross section, of the reading light module of the modular medical light system.
Figure 10:
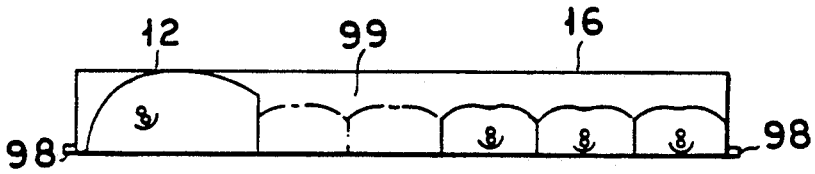
FIG. 10 is a side plan view, partly in cross section, of the reading light module and the patient examination light module, with a blank module or an extended patient examination light module (shown in phantom) therebetween.
Figure 11:
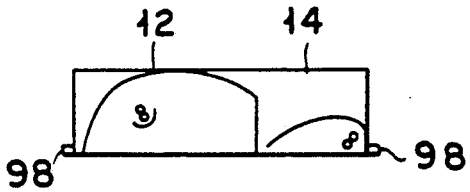
FIG. 11 is a side plan view, partly in cross section, of the reading light module and the ambient light module of the modular medical light system.

FIG. 4 shows reading light module 12 in more detail. Reading light module 12 includes housing 13 which contains reflector 22. Housing 13 is typically supported by a grid of inverted T-rails 101. Additionally, housing 13 may be supported by a frame or housing 98 as shown in FIGS. 10 and 11 and frame or housing 98 supported by the grid of inverted T-rails 101. Reflector 22 is highly specular and essentially ellipsoidal in shape with an axis 24 inclined so as to direct the light distribution pattern at an angle away from adjacent wall 300. U-shaped bulb 26, preferably a biax® or similar bulb, is placed with the centers of both legs 28, 30 intersecting inclined axis 24 so that the light is directed principally away from wall 300. Semi-circular shield 32 is placed around the lower leg 30 of U-shaped bulb 26. Edge 34 of shield 32 is aligned with the lower edge 38 of non-reflective barrier 20, as illustrated by line 400, to prevent uncontrolled direct emanation of glare from bulb 26. Edge 36 of shield 32 is similarly aligned with the lower edge 40 of reflector 22.

Figure 5:
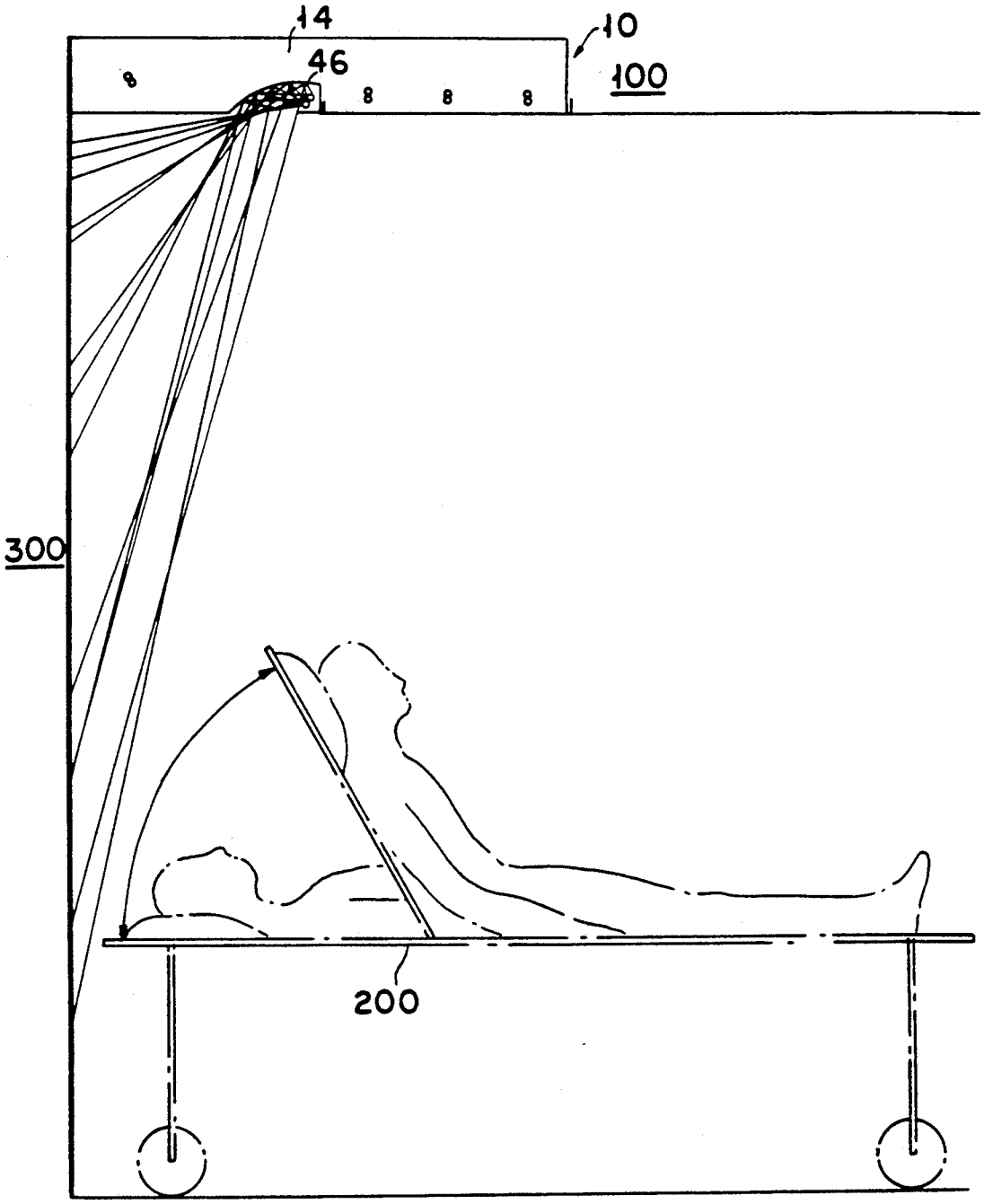
FIG. 5 is a side plan view, partly in cross section, of the modular medical lighting system showing the area of illumination of the ambient light module.

FIG. 5 shows the light distribution pattern of ambient light module 14 in relation to bed 200 and adjacent wall 300. The light is distributed substantially evenly along adjacent wall 300, preferably stopping short of the lowest portions of wall 300, so that the light can diffuse or "wash" from wall 300 thereby providing indirect ambient light to bed 200 and the surrounding area without emanating any substantial glare to the patient or persons standing in the immediate area.

Figure 6:
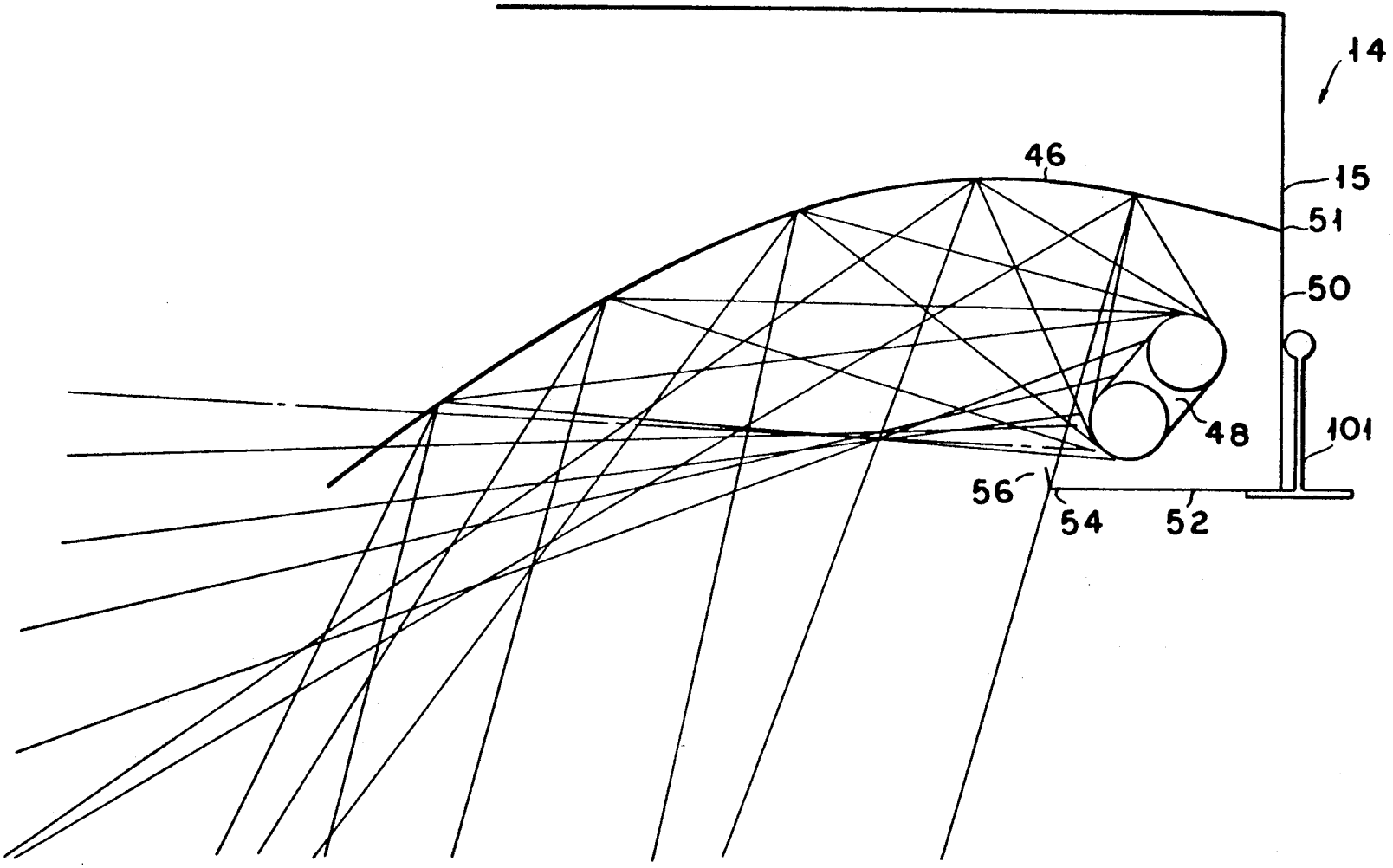
FIG. 6 is a side plan view, partly in cross section, of the ambient light module of the modular medical light system.
Figure 12:
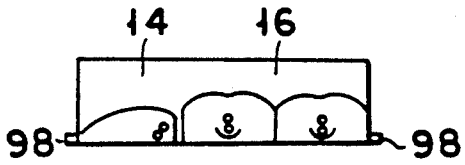
FIG. 12 is a side plan view, partly in cross section, of the ambient light module and the patient examination light module of the modular medical light system.

FIG. 6 shows ambient light module 14 in more detail. Ambient light module 14 includes housing 15 which contains highly specular polished reflector 46. Ambient light module 14 is typically supported by a grid of inverted T-rails 101. Additionally, housing 15 may be supported by a frame or housing 98 as shown in FIGS. 11 and 12 and frame or housing 98 supported by the grid of inverted T-rails. Highly specular polished reflector 46 is formed above and rearwardly from inclined U-shaped bulb 48 (preferably a biax® or similar bulb). The forward edge 51 of reflector 46 joins forward vertical wall 50 which, in turn, joins lower horizontal wall 52. The interior of both vertical wall 50 and horizontal wall 52 are preferably highly reflective white glossy enamel to eliminate hot spots and striping of the reflected light on wall 300. Horizontal wall 52 shields the patient from light directly from bulb 48. Similarly, the rearward edge 54 of horizontal wall 52 includes upwardly extending lip 56 to shield the patient from reflected lamp images.

The position and inclination of U-shaped bulb 48 provide direct light on the uppermost portion of wall 300 whereas the intermediate portion of wall 30 is illuminated by light reflected from reflector 46. As previously stated, preferably the lowest portion of wall 300 is not illuminated by ambient light module 14.

Figure 7:
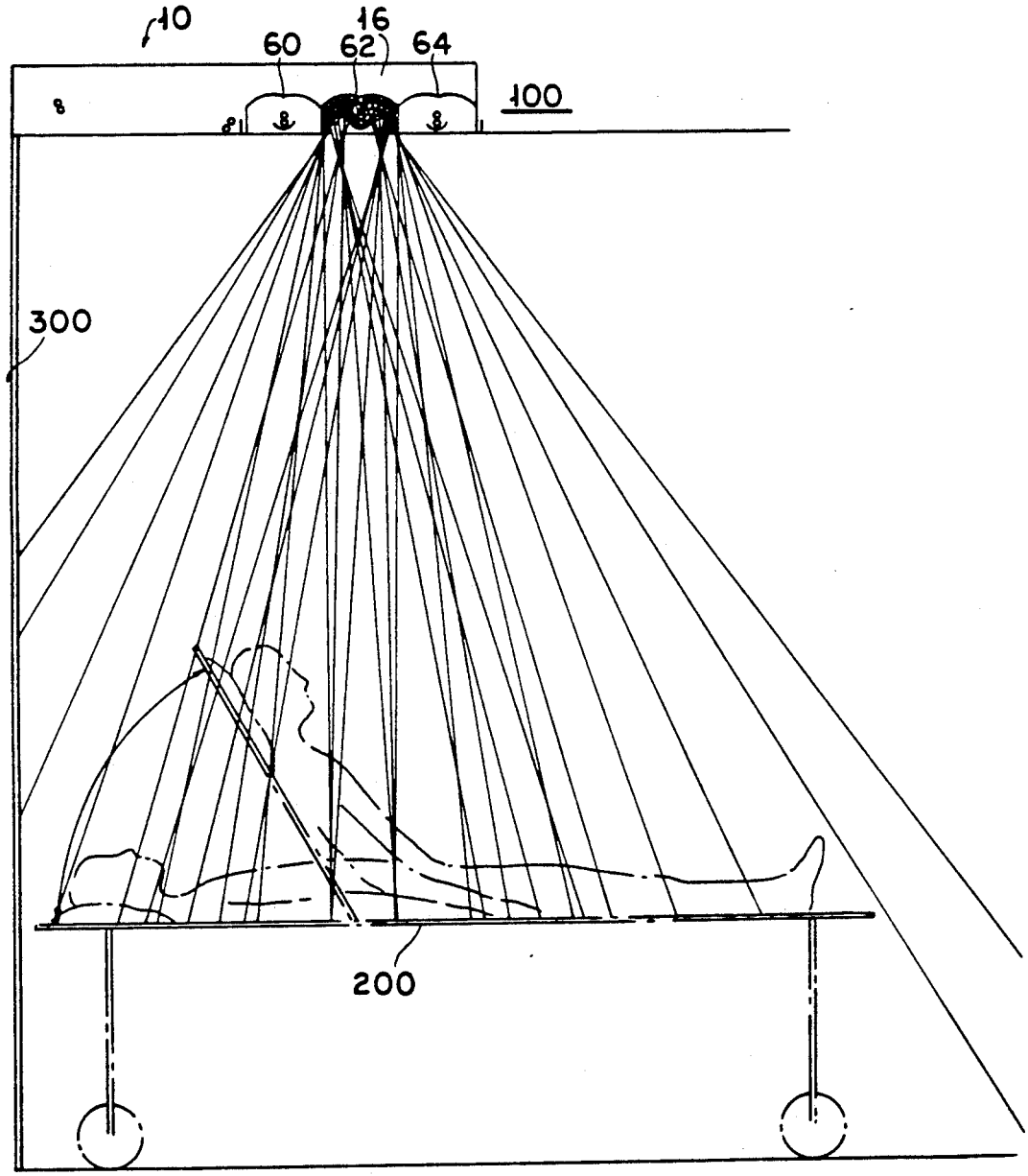
FIG. 7 is a side plan view, partly in cross section, of the modular medical lighting system showing the area of illumination of the patient examination light module.

FIG. 7 shows the light distribution pattern of examination light module 16 in relation to bed 200 and adjacent wall 300. Examination light module 16 preferably includes three substantially identical optical systems 60, 62, 64, but may include any number, including one, of optical systems. A plurality of optical systems allows the illumination intensity of examination light module 16 to be varied as appropriate for the care being administered to the patient.

Figure 8:
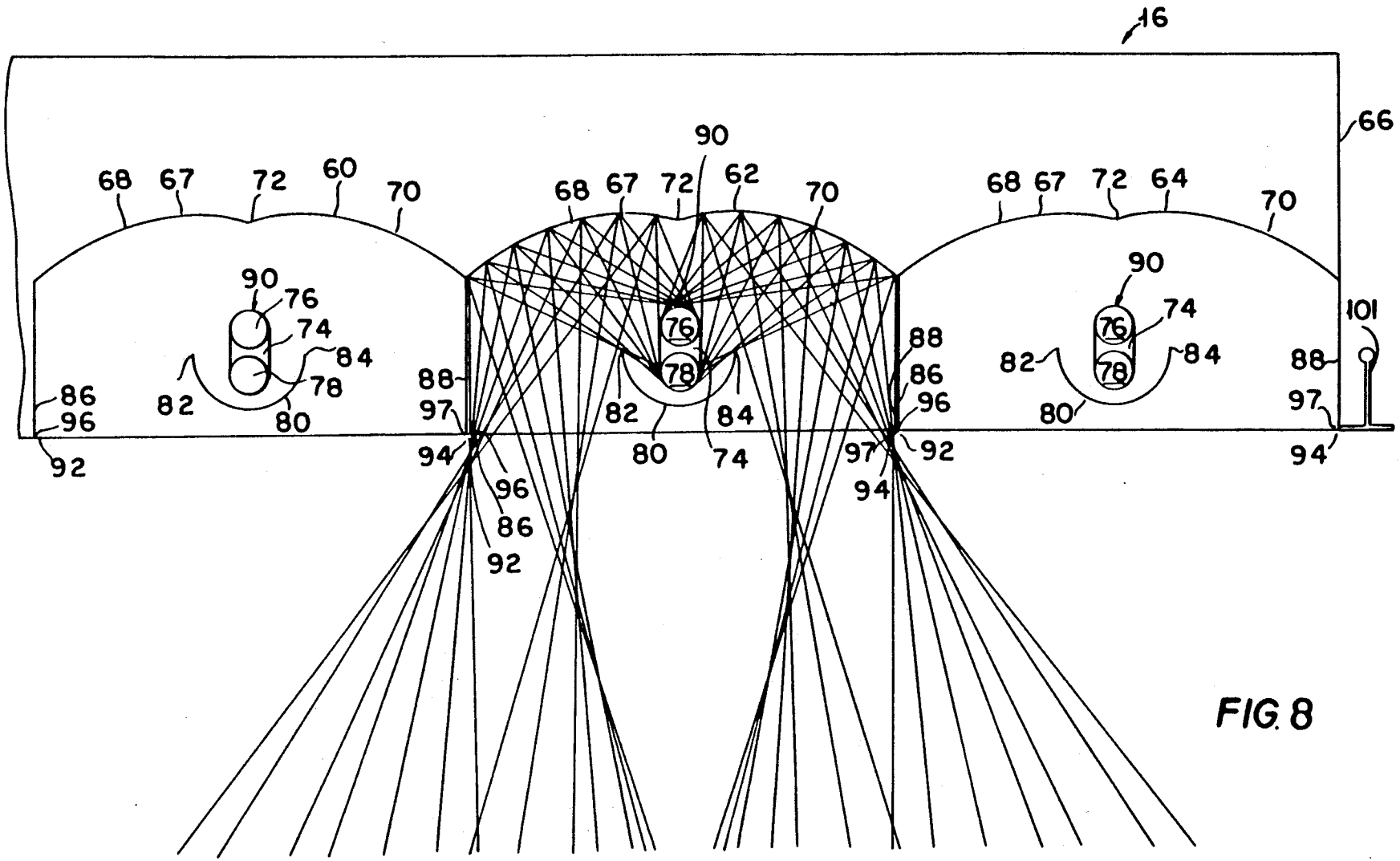
FIG. 8 is a side plan view, partly in cross section, of the patient examination light module of the modular medical light system.

FIG. 8 shows the examination light module 16 in more detail. Examination light module 16 includes housing 66 enclosing optical systems 60, 62, 64. Examination light module 16 is typically supported by a grid of inverted T-rails 101. Additionally, housing 66 may be supported by a frame or housing 98 and frame or housing 98 supported by the grid of inverted T-rails as shown in FIGS. 10 and 12. Each optical system 60, 62, 64 includes highly polished specular reflector 67 with two essentially ellipsoidal contours 68, 70 forming apex 72 therebetween. U-shaped bulb 74, preferably a biax ® or similar bulb, is positioned below apex 72 with first leg 76 immediately over second leg 78. Semi-circular shield 80 is positioned under second leg 78 with first and second edges 82, 84 vertically aligned with a central position between first leg 76 and second leg 78 so as substantially to eliminate the direct unreflected an uncontrolled emanation of light from examination light module 16. Outward ends of ellipsoidal contours 68, 70 join vertical non-reflective (preferably black) risers 86, 88.

Ellipsoidal contours 68, 70 are positioned with respect to bulb 74 so that the first focal point of both contours 68, 70 intersect at point 90 immediately above first leg 76. The second focal points 92, 94 of ellipsoidal contours 68, 70 occur immediately below the lower edges 96, 97 of vertical non-reflective risers 86, 88. Moreover, bulb 74 and ellipsoidal contours 68, 70 are configured to direct a beam within the angular limits generally of the patient's bed 200 as shown in FIG. 7.

Figure 9:
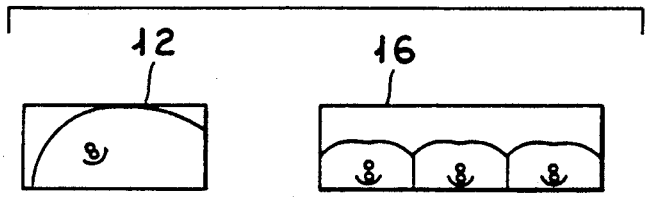
FIG. 9 is a side plan view, partly in cross section, of the reading light module and the examination light module.

FIG. 9 discloses how a reading light module 12 and a patient examination light module 16 can be separately mounted to provide their respective features.

FIG. 10 discloses a reading light module 12 and a patient examination light module 16 mounted on frame or housing 98 with a blank module 99 or additional optical systems (shown in phantom) of examination light module 16 between modules 12 and 16.

Similarly, FIG. 11 discloses a reading light module 12 and an ambient light module 14 in frame or housing 98 and FIG. 12 discloses an ambient light module 14 and an examination light module 16 in frame or housing 98. Additionally, any of modules 12, 14 or 16 can be provided as a separate fixture for their respective functions.

Reading light module 12 typically has an illumination value of approximately 70 foot-candles while ambient light module 14 typically has an illumination value of approximately 50 foot-candles and examination light module 16 typically has an illumination value of approximately 100 foot-candles.

The modular medical lighting system 10, whether provided as a complete system or assembled from individual modules, is recessed or surface mounted on ceiling 100. To use modular medical lighting system 10, the user typically operates an integrated switch mechanism (not shown) either on wall 300 or on a cord (not shown) accessible to the patient and/or medical personnel.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A medical lighting system comprising:

a first light fixture module oriented to direct light downwardly to a selected reading area under the medical lighting system, said first light fixture including a first reflector with an inclined axis, a first bulb generally under said first reflector, a forward wall blocking at least a portion of light reflected from said first bulb by said first reflector, and a first shield under said first bulb aligned with said first reflector and with a lower section of said forward wall to prevent non-reflected light from emanating directly from said first bulb outwardly from said first light fixture module;

a second light fixture module oriented to direct light downwardly and outwardly to a vertical wall surface outwardly adjacent from the medical lighting system whereby light is reflected back to a broad area under the medical lighting system, said second light fixture module including a second reflector, a second bulb forwardly disposed generally under said second reflector, a wall forward of said second reflector, and a horizontal section joining a lower portion of said wall forward of said second reflector, wherein said wall forward of said second reflector and said horizontal section are positioned with respect to said second bulb to directly illuminate uppermost portions of the vertical wall surface from said second bulb and indirectly illuminate intermediate portions of the vertical wall surface by light reflected from said second bulb by said second reflector; and a third light fixture module oriented to direct light downwardly under the medical lighting system to a selected patient examination area under the medical lighting system, said third light fixture module including at least one optical system, each of said optical systems including a third reflector including two substantially ellipsoidal contours forming a apex therebetween, a third bulb directly below said apex, vertical risers at outermost edges of said optical system intersecting with outermost edges of said contours, and a second shield under said third bulb aligned with lower ends of said vertical risers to prevent non-reflected light to emanate directly from said third bulb outwardly from said third light fixture module.

2. The medical lighting system of claim 1 wherein said first bulb, said second bulb, and said third bulb are fluorescent bulbs.

3. The medical lighting system of claim 2 wherein said first bulb, said second bulb, and said third bulb are U-shaped.

4. The medical lighting system of claim 3 wherein said first bulb, said second bulb, and said third bulb are "biax" bulbs.

5. The medical lighting system of claim 1 wherein said first reflector is generally ellipsoidal and said inclined axis passes through a longitudinal axis of said first bulb.

6. The medical lighting system of claim 5 wherein said first bulb is a U-shaped fluorescent bulb including a first leg and a second leg and wherein said inclined axis passes through a longitudinal axis of said first leg and said second leg.

7. The medical lighting system of claim 6 wherein said first shield has a semi-circular cross section and wherein edges of said first shield are aligned with a central portion of said first bulb.

8. The medical lighting system of claim 1 wherein said wall forward of said second reflector and said horizontal section are reflective glossy enamel on surfaces facing said second bulb.

9. The medical lighting system of claim 1 wherein said second bulb is a U-shaped fluorescent bulb with an upper leg horizontally offset from a lower leg.

10. The medical lighting system of claim 1 wherein said horizontal section includes a upwardly extending lip.

11. The medical lighting system of claim 1 wherein each of said two contours includes a first focal point intersecting immediately above said third bulb, and a second focal point immediately below a respective vertical riser.

12. The medical lighting system of claim 11 wherein said third bulb is a fluorescent bulb; wherein said second shield has a semi-circular cross section and wherein edges of said second shield are aligned with a central portion of said third bulb.

13. The medical lighting system of claim 1 wherein the medical lighting system is four feet in length, two feet in width, and includes means for engaging a grid of inverted T-shaped rails.

14. A medical lighting system comprising:

a first light fixture module oriented to direct light downwardly and outwardly to a vertical wall surface outwardly adjacent from the medical lighting system whereby light is reflected back to a broad area under the medical lighting system, said first light fixture module including a first reflector, a first bulb forwardly disposed generally under said first reflector, a wall forward of said first reflector, and a horizontal section joining a lower portion of said wall forward of said first reflector, wherein said wall forward of said first reflector and said horizontal section are positioned with respect to said first bulb to directly illuminate uppermost portions of the vertical wall surface from said first bulb and indirectly illuminate intermediate portions of the vertical wall surface by light reflected from said first bulb by said first reflector; and a second light fixture module oriented to direct light downwardly under the medical lighting system to a selected patient examination area under the medical lighting system, said second light fixture module including at least one optical system, each of said optical systems including a second reflector including two substantially ellipsoidal contours forming an apex therebetween, a second bulb directly below said apex, vertical risers at outermost edges of said optical system intersecting with outermost edges of said contours, and a shield under said second bulb aligned with lower ends of said vertical risers to prevent non-reflected light to emanate directly from said second bulb outwardly from said second light fixture module.

15. The medical lighting system of claim 14 wherein said first bulb and said second bulb are fluorescent bulbs.

16. The medical lighting system of claim 15 wherein said first bulb and said second bulb are U-shaped.

17. The medical lighting system of claim 16 wherein said first bulb and said second bulb are "biax" bulbs.

18. The medical lighting system of claim 14 wherein said wall forward of said first reflector and said horizontal section are reflective glossy enamel on surfaces facing said first bulb.

19. The medical lighting system of claim 14 wherein said first bulb is a U-shaped fluorescent bulb with an upper leg horizontally offset from a lower leg.

20. The medical lighting system of claim 14 wherein said horizontal section includes an upwardly extending lip.

21. The medical lighting system of claim 14 wherein each of said two contours includes a first focal point intersecting immediately above said second bulb, and a second focal point immediately below a respective vertical riser.

22. The medical lighting system of claim 14 wherein said second bulb is a fluorescent bulb; wherein said shield has a semi-circular cross section and wherein edges of said shield are aligned with a central portion of said second bulb.

23. The medical lighting system of claim 14 further including means for engaging a grid of inverted T-shaped rails.

24. A medical lighting system comprising:

a first light fixture module oriented to direct light downwardly to a selected reading area under the medical lighting system, said first light fixture including a first reflector with an inclined axis, a first bulb generally under said first reflector, a forward wall blocking at least a portion of light reflected from said first bulb by said first reflector, and a first shield under s id first bulb aligned with said first reflector and with a lower section of said forward wall to prevent non-reflected light from emanating directly from said first bulb outwardly from said first light fixture module; and a second light fixture module oriented to direct light downwardly under the medical lighting system to a selected patient examination area under the medical lighting system, said second light fixture module including at least one optical system, each of said optical systems including a second reflector including two substantially ellipsoidal contours forming an apex therebetween, a second bulb directly below said apex, vertical risers at outermost edges of said optical system intersecting with outermost edges of said contours, and a second shield under said second bulb aligned with lower ends of said vertical risers to prevent non-reflected light to emanate directly from said second bulb outwardly from said second light fixture module.

25. The medical lighting system of claim 24 wherein said first bulb and said second bulb are fluorescent bulbs.

26. The medical lighting system of claim 25 wherein said first bulb and said second bulb are U-shaped.

27. The medical lighting system of claim 26 wherein said first bulb and said second bulb are "biax" bulbs.

28. The medical lighting system of claim 24 wherein said first reflector is generally ellipsoidal and said inclined axis passes through a longitudinal axis of said first bulb.

29. The medical lighting system of claim 2 wherein said first bulb is a U-shaped fluorescent bulb including a first leg and a second leg and wherein said inclined axis passes through a longitudinal axis of said first leg and said second leg.

30. The medical lighting system of claim 24 wherein said first shield has a semi-circular cross section and wherein edges of said first shield are aligned with a central portion of said first bulb.

31. The medical lighting system of claim 24 wherein each of said two contours includes a first focal point intersecting immediately above said second bulb, and a second focal point immediately below a respective vertical riser.

32. The medical lighting system of claim 24 wherein said second bulb is a fluorescent bulb; wherein said second shield has a semi-circular cross section and wherein edges of said second shield are aligned with a central portion of said second bulb.

33. The medical lighting system of claim 24 further including means for engaging a grid of inverted T-shaped rails.

34. A medical lighting system comprising:

a first light fixture module oriented to direct light downwardly to a selected reading area under the medical lighting system, said first light fixture including a first reflector with an inclined axis, a first bulb generally under said first reflector, a forward wall blocking at least a portion of light reflected from said first bulb by said first reflector, and a first shield under said first bulb aligned with said first reflector and with a lower section of said forward wall to prevent non-reflected light from emanating directly from said first bulb outwardly from said first light fixture module; and a second light fixture module oriented to direct light downwardly and outwardly to a vertical wall surface outwardly adjacent from the medical lighting system whereby light is reflected back to a broad area under the medical lighting system, said second light fixture module including a second reflector, a second bulb forwardly disposed generally under said second reflector, a wall forward of said second reflector, and a horizontal section joining a lower portion of said wall forward of said second reflector, wherein said wall forward of said second reflector and said horizontal section are positioned with respect to said second bulb to directly illuminate uppermost portions of the vertical wall surface from said second bulb and indirectly illuminate intermediate portions of the vertical wall surface by light reflected from said second bulb by said second reflector.

35. The medical lighting system of claim 34 wherein said first bulb and said second bulb are fluorescent bulbs.

36. The medical lighting system of claim 34 wherein said first bulb and said second bulb are U-shaped.

37. The medical lighting system of claim 34 wherein said first bulb and said second bulb are "biax" bulbs.

38. The medical lighting system of claim 34 wherein said first reflector is generally ellipsoidal and said inclined axis passes through a longitudinal axis of said first bulb.

39. The medical lighting system of claim 38 wherein said first bulb is a U-shaped fluorescent bulb including a first leg and a second leg and wherein said inclined axis passes through a longitudinal axis of said first leg and said second leg.

40. The medical lighting system of claim 39 wherein said first shield has a semi-circular cross section and wherein edges of said first shield are aligned with a central portion of said first bulb.

41. The medical lighting system of claim 34 wherein said wall forward of said second reflector and said horizontal section are reflective glossy enamel on surfaces facing said second bulb.

42. The medical lighting system of claim 34 wherein said second bulb is a U-shaped fluorescent bulb with an upper leg horizontally offset from a lower leg.

43. The medical lighting system of claim 34 wherein said horizontal section includes a upwardly extending lip.

44. The medical lighting system of claim 34 further including means for engaging an inverted grid of T-shaped rails.

* * * * *